US006805046B1

(12) United States Patent
Rasmussen

(10) Patent No.: US 6,805,046 B1
(45) Date of Patent: Oct. 19, 2004

(54) PATTERN CARRIER FOR USE IN TRANSFER PATTERN PRINTING AND THE USE OF A NON-CRYSTALLINE SACCHARIDE SYRUP IN A DISPERSION FOR COATING A PAPER WEB SO AS TO OBTAIN SUCH A PATTERN CARRIER

(75) Inventor: Knud Villefrance Rasmussen, Silkeborg (DK)

(73) Assignee: Dansk HK Ltd., Tsuen Wan N.T. (HK)

( * ) Notice: Subject to any disclaimer, the term of this patent is extended or adjusted under 35 U.S.C. 154(b) by 0 days.

(21) Appl. No.: 09/763,687

(22) PCT Filed: Aug. 16, 1999

(86) PCT No.: PCT/DK99/00436

§ 371 (c)(1),
(2), (4) Date: Apr. 5, 2001

(87) PCT Pub. No.: WO00/12809

PCT Pub. Date: Mar. 9, 2000

(30) Foreign Application Priority Data

Aug. 26, 1998 (DK) ..... 1998 01070

(51) Int. Cl.[7] ..... B41D 7/00
(52) U.S. Cl. ..... 101/33; 101/34; 8/467
(58) Field of Search ..... 101/33, 34, 178, 101/429.2, 128.21, 424.1; 8/467, 543, 552, 558, 561, 562, 916, 918, 919, 495; 427/152, 209, 210, 211, 415; 347/102

(56) References Cited

U.S. PATENT DOCUMENTS

| | | | | |
|---|---|---|---|---|
| 5,196,030 A | | 3/1993 | Akerblom et al. | |
| 6,054,249 A | * | 4/2000 | Nagahara et al. | 430/273.1 |
| 6,066,593 A | * | 5/2000 | Obata et al. | 503/227 |
| 6,254,888 B1 | * | 7/2001 | Cappola | 424/474 |
| 6,280,831 B1 | * | 8/2001 | Nakanishi et al. | 428/211 |

FOREIGN PATENT DOCUMENTS

JP B 44-16135 7/1969

* cited by examiner

*Primary Examiner*—Ren Yan
(74) *Attorney, Agent, or Firm*—Oliff & Berridge, PLC

(57) ABSTRACT

A pattern carrier for use in transfer pattern printing of textiles comprises paper with an air permeability (Bendtsen-porosity) of more than 500 ml/min and a water absorption corresponding to a Cobb-number of at least 50, said paper being coated with an aqueous dispersion of carboxymethylcellulose containing a non-crystallizing saccharide syrup, preferably in an amount of approximately 30 g of dispersion per $m^2$, whereafter one or more color pattern are printed on said paper, each color pattern comprising a water-soluble or dispersible dye admixed an easily soluble thickening carrier with a temporary binding effect, preferably in form of carboxymethylcellulose. The use of a saccharide syrup, preferably a sorbitol syrup, for the coating renders it possible to use standard-absorbing crude paper as the basis of the pattern carrier, which provides obvious financial and production-related advantages.

19 Claims, 1 Drawing Sheet

PAPER PRINTING
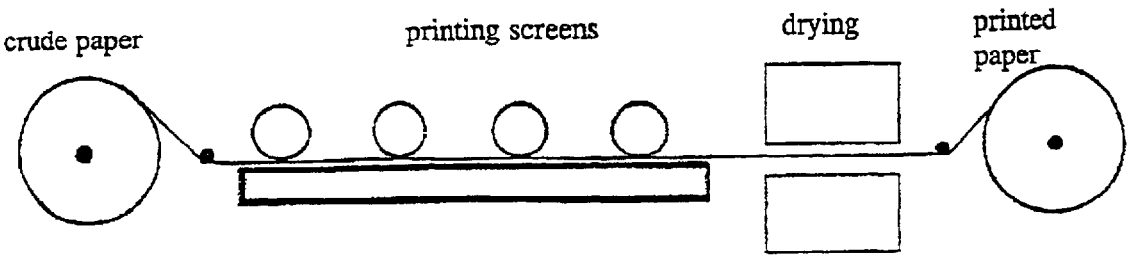
TRANSFER PRINTING
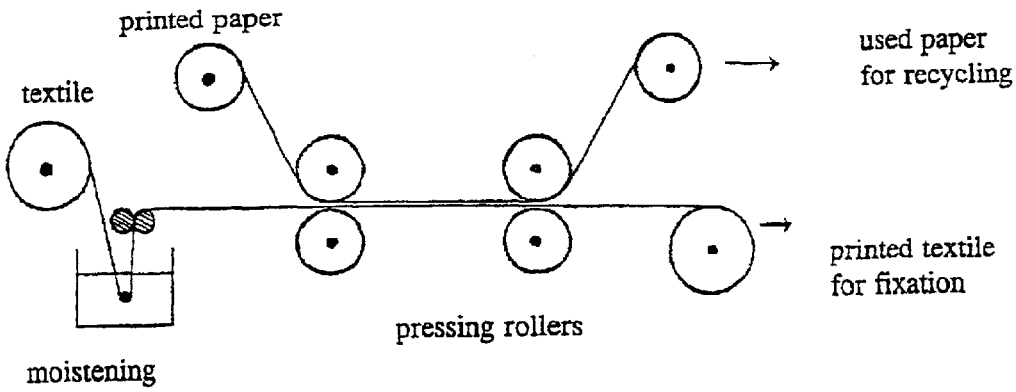

PATTERN CARRIER FOR USE IN TRANSFER PATTERN PRINTING AND THE USE OF A NON-CRYSTALLINE SACCHARIDE SYRUP IN A DISPERSION FOR COATING A PAPER WEB SO AS TO OBTAIN SUCH A PATTERN CARRIER

TECHNICAL FIELD

The present invention relates to a pattern carrier in form of a paper web with a colour pattern printed thereon and to be used in transfer pattern printing of a moist textile web. The invention relates also to the use of a saccharide syrup known per se as an ingredient in a dispersion for coating a paper web so as to obtain a pattern carrier with particular properties.

BACKGROUND ART

Transfer pattern printing is a well-known and extensively used technique, which involves a continuous transfer of a pre-printed pattern from a pattern carrier web to a moist textile web, where the two webs are continuously brought into contact with one another in a transfer region which is frequently in the form of one or more pairs of pressure rollers, cf. the Figure.

In principle various types of the technique have been known since the twenties but the technique did not become commercially interesting until the late fifties. Various types of transfer printing have been described inter alia in U.S. Pat. Nos. 1,651,470 and 1,783,606, FR-PS Nos. 1 034 816 and 1 036 510, DK patent applications Nos. 5666/68 and 1 566/69, SE-PS No. 137 674, GB-PS Nos. 1 430 832 and 1 480 328, U.S. Pat. Nos. 1,965,257 and 1,993,524, DE published specification Nos. 2 710 158 and 2 702 300 and U.S. Pat. No. 4,057,864. Common to the procedures described in these publications was that it was not possible to obtain acceptable results without involving a heating and/or dyes based on volatile organic solvents. Frequently, useful results required the use of so long contact times that it was in fact not a question of continuous printing processes.

Therefore it was a major breakhough for the transfer printing when the Applicant in the late eighties succeeded in developing a process for transfer pattern printing whereby it was possible simultaneously to avoid the heating and the use of organic solvents. The process is described in DK-PS No. 169 135 and is characterised by a suitable choice of pattern carrier and dye formulations, an accurate control of the moistening of the textile web and the use of a suitably high pressure, whereby particularly good reproducible results can be obtained at rather high processing speeds and, as mentioned, without the use of heating and exclusively by the use of water-based dye formulations. In addition to the production-related advantages and the particularly good product qualities, the process according to DK-PS No. 169 135 also presented obvious environmental and energy-related advantages as well as a substantially improved working environment.

This epoch-making process is, however, also subject to limitations. To be more precise this process presents particular requirements to the paper used as pattern carrier because said paper must be of a specific nature in order to be coated with a colour pattern at the desired printing speed. It is necessary to use a paper quality which is only slightly absorbing, and in order to avoid that the various, applied colours become blurred it is necessary to strongly cool the paper web between each application of colour in order to solidify the colour.

The printing of the paper is carried out by means of printing screens as shown in the Figure. Thus the process according to DK-PS No. 169 135 necessitates introduction of cooling rollers not shown between the individual printing screens. The coated paper web is carried around these cooling rollers while subjected to a cooling to below −20° C. In this manner it is possible to prevent the colours applied from various printing screens from being blurred. However, this "freezing" does, of course, complicate the entire process significantly and intensifies the costs involved, and accordingly it is desired to provide a pattern carrier where the colours do not become blurred—not even at high printing speeds, and which therefore does not require a cooling between the individual applications of colour.

Coating a paper surface with a suitably selected substance in order to alter the absorption properties of the paper is per se a well-known process. DE published specification No. 35 04 814 thus discloses a process for transfer pattern printing of a textile web, in which paper coated with for instance carboxymethylcellulose is used as a pattern carrier. DE accepted published specification No. 27 01 392 also discloses a process for transfer pattern printing of a textile material. Paper is used as a pattern carrier in this process, said paper being coated with carboxymethylcellulose and the dye being transferred from the pattern carrier to the textile by means of heat and/or pressure.

It is on the whole well-known to use carboxymethylcellulose as the substance with which a paper surface is coated. According to the above DK patent No 169 135 a pattern carrier of a lightly absorbing, preferably coated paper is thus used, the coating or application being made with carboxymethylcellulose, an alginate or an aqueous dispersion of polyethylene or polyacrylate, preferably carboxymethylcellulose which is an easily accessible substance with advantageous properties. However, the carboxymethylcellulose is per se not sufficient to provide standard-absorbing crude paper with the desired absorption properties.

The use of saccharides in the manufacture of transfer paper has hitherto only been described in JP patent application No 44-16135. However, this application relates to a transfer paper for transferring colour patterns to porcelain and ceramics. By adding one or several mono- or oligosaccharides to the water-soluble paste containing a cellulose derivate with which the paper is coated a paper is sought to be obtained which is more easily removed from the porcelain or ceramic object after the pattern has been transferred thereto. Furthermore, by using a transfer paper containing such saccharides, a pattern is obtained which retains its clear outlines after baking of the porcelain or ceramic object. The transfer paper according to the Japanese publication must be coated twice, the lower coating consisting of an aqueous solution of the cellulose derivative alone and the upper coating consisting of the same solution to which the chosen saccharide has been added. A water-resistant layer is subsequently applied on top of said layers, said water-resistant layer according to the examples being a 30% acetone solution of acetyl cellulose. This known transfer paper is thus considerably more complicated than the coated paper according to the present invention and is used for a completely different purpose.

BRIEF DESCRIPTION OF THE INVENTION

It has now surprisingly been found that it is possible to produce such a pattern carrier from standard-absorbing paper by coating said paper with an aqueous dispersion of carboxymethylcellulose containing a non-crystalline saccharide syrup. This coating presents the unexpected feature that it allows an immediate penetration of the moistness from the printing dye while the dye concentrate remains on the surface together with the carboxymethylcellulose. As a result the paper surface remains dry and the individual colour patterns do not become blurred. These colour patterns can be easily removed again from the paper during the subsequent transfer printing.

The invention relates therefore to a pattern carrier in form of a paper web with a colour pattern printed thereon to be used in transfer pattern printing of a moist textile web by a compressing of the two webs between one or more pairs of rollers without the use of heat, but under such a linear pressure that the textile web is subjected over a short length to a compressing into a reduced thickness followed by a natural expansion, whereby the colour pattern is absorbed from the pattern carrier into the textile web, and the pattern carrier according to the invention is characterised in that it is made of paper with an air permeability (Bendtsen-porosity) of more than 500 ml/min, measured according to the standard DIN 53120 T1, and a water absorption corresponding to a Cobb-number measured according to the standard SCAN-P12:64, $Cobb_{60}$, of at least 50, said paper being coated with an aqueous dispersion of carboxymethylcellulose containing a non-crystalline saccharide syrup, preferably in an amount of approximately 30 g of dispersion per $m^2$, whereafter one or more colour patterns are printed on said paper, each colour pattern comprising a water-soluble or dispersible dye admixed an easily soluble thickening carrier with a temporary binding effect, preferably in form of carboxymethylcellulose.

The ingredient of the dispersion providing the paper web with surprising and useful properties is a non-crystalline saccharide syrup, which is preferably a sorbitol syrup. Such products are conventionally used within the food industry, whereas the use thereof for coating ordinary paper is less widely known. The products have thus never been used for coating of ordinary paper which subsequently are used as pattern carriers in connection with transfer printing on textiles.

Therefore the invention also relates to the use of a non-crystallizing saccharide syrup as an ingredient in an aqueous dispersion for coating a paper web in order to obtain a pattern carrier with a surface which can drain off immediately the moistness deriving from the printing dye while said dye remains on the surface together with the carboxymethylcellulose.

The invention presents several obvious advantages. First of all the choice of paper for the pattern carrier is far less critical than previously because it is possible to use ordinary standard-absorbing crude paper which is considerably less expensive than the paper hitherto used. Moreover, the coated paper according to the invention facilitates the printing thereon of the colour pattern. No skilled work is involved and accordingly no particular training of the employees is required, whereby the printing of the colour pattern on the coated paper to a far higher degree than previously can be carried out locally. The consumption of dye is of the same magnitude as the consumption related to the hitherto used paper, but the wastage rate is significantly lower than previously especially in connection with transfer printing on cellulose fibres and other natural fibres. The ready printed paper can be used in the same manner as previously, viz. by the same process and in the same machines as described in DK-PS No. 169 135. As a result the same advantages as at the process according to DK patent No. 169 135 are obtained, viz. transfer printing on textiles carried out at a high production rate without use of volatile solvents and without heating while using standard-absorbing crude paper as pattern carrier, any form of drying or cooling between each printing screen being rendered superfluous when printing the pattern carrier.

The selected crude paper is coated in a covering layer with the aqueous dispersion of carboxymethylcellulose comprising the non-crystalline saccharide syrup, preferably in an amount of approximately 30 g of dispersion per $m^2$ of paper surface. A typical dispersion presents the following composition (by weight):

| | |
|---|---|
| 68% | of water |
| 20% | of saccharide syrup |
| 12% | of carboxymethylcellulose (dry weight). |

It is possible to add a light dye pigment in order to allow a visual evaluation of whether the coating is covering or not.

The paper is coated on the printing side thereof by means of a screen roller. It is also possible to carry out the coating "on-line" in the same cycle of operations on the paper producing machine when the crude paper is produced. The coated paper is subsequently subjected to a printing by passing a number of printing screens (A,B, C,D, . . . ), cf. the Figure, whereby the desired colour pattern is printed thereon by means of a screen for each colour. The particular nature of the coating implies that the applied colour dries up immediately with the result that the paper can be advanced directly from one screen to the next screen without requiring intermediate drying or freezing. The printing is usually carried out at a paper rate of 60–80 m per minute, ie about 1 m/sec. Even though this rate is fairly high, according to the invention the printing of the paper proceeds without any problems, as the surface dries up and the colour solidifies so quickly (within less than one second) that the paper surface immediately after passing screen A and long before passing screen B is completely dry etc. When the desired colour pattern has been obtained after passing the last printing screen (D on the Figure), the printed paper is subjected to a final drying and then wound up on a roller.

The transfer printing per se on a textile web is carried out in a manner known per se by said textile web after moistening thereof in an alkaline bath and a controlled compressing so as to obtain a specific moistness being joined with the printed paper web between one or more pairs of pressing rollers at a suitably high pressure. Finally, the colour printed on the textile web is fixed in a manner known per se, and the used pattern carrier is re-circulated so as to allow a reuse of the paper.

The saccharide syrup used is preferably based on sorbitol, but other sugars such as glucose, fructose, mannose, galactose, arabinose, xylose, ribose and the like can also be used. A particularly preferred saccharide syrup is the product "Sorbidex 200" from the company Cerestar. This product comprises predominantly sorbitol, but comprises also small amounts of mannitol (approximately 1.1%) and reducing sugars (approximately 0.1%).

The aqueous dispersion comprises also a carboxymethylcellulose. This carboxymethylcellulose can for instance be "Ambergum®1221", which is a water-soluble, anionic cellulose polymer from the company Aqualon. This product is also suited as ingredient in the printing colour formulations.

The new pattern carrier according to the invention is particularly suited for use in transfer printing on cellulose fibres and other natural fibres by the process according to DK-PS No. 169 135. In principle, patterns of any water-soluble or water-dispersible dye, such as substative dyes, cationic dyes, chromium-complex dyes, reactive dyes and pigments can be printed on the pattern carrier according to the invention. Among these dyes, the reactive dyes are particularly preferred.

In addition, the pattern carrier according to the invention can be used for printing of dispersion dyes on webs of synthetic fibres. A colour pattern can also be printed on the pattern carrier according to the invention by way of "inkjet"-printing, and a pattern of acid dyes can also be printed thereon.

The invention is illustrated in greater detail by means of the following Examples:

EXAMPLES

The following examples involve the use of a machine-glazed base paper of the brand "Transferroto Classico" type 814 from the company Cham Tenero. This paper has a weight of a thousand grains indicated in grammes of 65.0 g/m$^2$, a "Bendtsen-porosity" (air permeability) of 700 ml/min, measured according to the standard DIN 53120 T1, a water absorption corresponding to a Cobb-number of 55.5 measured according to the standard SCAN-P12:64, Cobb$_{60}$, a relative wet strength of 9.5% and an ultimate strength of 63.6 N/15 mm measured according to the standard DIN EN ISO 1924-2.

The paper is coated on the printing side with an aqueous dispersion comprising:

| | |
|---|---|
| 83.4 kg | "Sorbidex 200" and |
| 50.0 kg | "Ambergum ® 1221" carboxymethylcellulose (CMC) |

stirred in 283.6 kg of water. For the toning of the dispersion it is possible to add, if desired, 1.25 kg of the dyes Pigmatex red and Pigmatex yellow (half of each) in order to visualize the coating.

Example 1

A two-coloured pattern is applied onto a textile web of cellulose fibres (viscose and cotton). The textile is pre-treated in an ordinary way before the printing: It must be completely clean, and if it tends to roll at the rims it must be glued along said rims.

The two colour patterns are printed on the coated paper on a Stork RT printing machine by means of cylindric screens. The two paste recipes are as follows:

| Recipe 1: | |
|---|---|
| Reactive dye (Rematrans Rot 358) | 100 g |
| Natural thickener (Na—CMC) | 120 g |
| Synthetic thickener (Alcoprint RTA) | 6.8 g |
| Anti-foaming agent (Alcopol o 60%) | 1.1 g |
| Complexing agent (Ladiquest 1097) | 11 g |
| Demineralized water up to | 1000 g |
| Recipe 2: | |
| Reactive dye (Rematrans Blau 257) | 200 g |
| Natural thickener (Na—CMC) | 120 g |
| Synthetic thickener (Alcoprint RTA) | 6.8 g |
| Anti-foaming agent (Alcopol o 60%) | 1.1 g |
| Complexing agent (Ladiquest 1097) | 11 g |
| Demineralized water up to | 1000 g |

-continued

The two-coloured pattern is transferred from the paper web to the textile web on a "Cotton Art" standard machine, said textile web being moistened in advance by means of a mixture of

| | |
|---|---|
| NaOH, 34° Bé | 50 g/l |
| Sodium silicate, 36° Bé | 100 g/l |
| Complexing agent (Ladiquest 1097) | 1 g/l |
| Demineralized water up to | 1 l |

The fluid absorption in the textile web is approximately 65%.

The dye is fixed on the textile in a manner known per se by way of the "Cold-pad-batch"-process.

Example 2

The same textile web and the same pretreatment are used as in Example 1.

A multicoloured pattern is printed on the coated paper in an "Ink Jet Printer" total width machine (width 140 to 180 cm). Concentrated colours of the brand Rematrans are used in the machine, preferably:

| | |
|---|---|
| Rematrans | Gelb 089 |
| — | Goldgelb 070 |
| — | Orange 035 |
| — | Rot 004 |
| — | Rot 358 |
| — | Blau 267 |
| — | Blau 257 |
| — | Türkis 216 |
| — | Grün 201 |
| — | Schwarz 288 |
| — | Schwarz 263 |
| — | Schwarz 258 |

The paper with the colour pattern printed thereon is used for transfer printing of the textile web as described in Example 1, whereafter the colour is fixed on the textile as described in Example 1.

Example 3

A two-coloured pattern is applied onto a textile web of polyamide which has been subjected to an ordinary pretreatment.

The two colour patterns are printed on the coated paper on a Stork RT printing machine by means of cylindric screens. The two paste recipes are as follows:

| Recipe 1: | |
|---|---|
| Acid dye (Erionyl Blau) | 300 g |
| Natural thickener (Na—CMC) | 150 g |
| Complexing agent | 10 g |
| Demineralized water up to | 1000 g |

An adjustment is carried out to pH 8 by means of NaOH.

| Recipe 2: | |
|---|---|
| Acid dye (Erionyl Bordeaux) | 400 g |
| Natural thickener (Na—CMC) | 100 g |
| Complexing agent | 10 g |
| Demineralized water up to | 1000 g |

An adjustment is carried out to pH 8 by means of NaOH.

The two-coloured pattern is transferred from the paper web to the textile web on a "Cotton Art" standard machine, said textile web being moistened in advance in a fluid bath of the following composition:

| | |
|---|---|
| Natural thickener (Na—CMC) | 5 g |
| Demineralized water up to | 1000 g |

An adjustment is carried out by means of an acid/buffer to pH 3.

The fluid absorption in the textile web is approximately 45%.

The dye is fixed on the textile by way of the "Cold-pad-batch"-process.

Example 4

A tree-coloured pattern is applied onto a textile web of polyester, which has been subjected to an ordinary pretreatment.

The three colour patterns are printed on the coated paper on a Stork RT printing machine by means of cylindric screens. The three paste recipes are as follows:

| | |
|---|---|
| Recipe 1: | |
| Teraprint Rot 5 g (dispersion dye) | 100 g |
| Lyoprint TFA | 27 g |
| Lyoprint AP | 7 g |
| Lyoprint BS Conc. | 90 g |
| NaOH | 5 g |
| Recipe 2: | |
| Teraprint Gelb G (dispersion dye) | 100 g |
| Lyoprint TFA | 27 g |
| Lyoprint AP | 7 g |
| Lyoprint BS Conc. | 90 g |
| NaOH | 5 g |
| Recipe 3 | |
| Teraprint Blau 6R (dispersion dye) | 100 g |
| Lyoprint TFA | 27 g |
| Lyoprint AP | 7 g |
| Lyoprint BS Conc. | 90 g |
| NaOH | 5 g |

The colour pattern is transferred from the paper web to the textile web on a Lemaire HTP standard machine for transfer printing. The machine is set at 215° C., and a contact time of 25 sec. is used.

Here it is a question of a dry process. The colour has been fixed when the textile, leaves the machine.

What is claimed is:

1. A pattern carrier in form of a paper web with a colour pattern printed thereon to be used in transfer pattern printing of a moist textile web by a compressing of the two webs between one or more pairs of rollers without the use of heat, but under such a linear pressure that the textile web is subjected over a short length to a compressing into a reduced thickness followed by a natural expansion, whereby the colour pattern is absorbed from the pattern carrier into the textile web, characterised in that the pattern carrier is made of paper with an air permeability of more than 500 ml/min, measured according to the standard DIN 53120 T1, and a water absorption corresponding to a Cobb-number, measured according to the standard SCAN-P12:64, $Cobb_{60}$, of at least 50, said paper being coated with an aqueous dispersion of carboxymethylcellulose containing a non-crystalline saccharide syrup, whereafter one or more colour patterns are printed on said paper, each colour pattern comprising a water-soluble or dispersible dye admixed with an easily soluble thickening carrier with a temporary binding effect.

2. A pattern carrier according to claim 1, characterised in that the saccharide syrup used comprises sorbitol as main ingredient.

3. A pattern carrier according to claim 2, characterised in that the saccharide syrup used in addition to sorbitol comprises small amounts of mannitol and reducing sugars.

4. A pattern carrier according to claim 3, characterised in that the saccharide syrup used represents approximately 20% by weight of the dispersion.

5. A pattern carrier according to claim 1, wherein said aqueous dispersion is coated on said paper in an amount of approximately 30 g of dispersion per $m^2$ of paper.

6. A pattern carrier according to claim 1, wherein said thickening carrier is carboxymethylcellulose.

7. A pattern carrier with a colour pattern printed thereon, comprising paper with an air permeability of more than 500 ml/min, measured according to the standard DIN 53120 T1, and a water absorption corresponding to a Cobb-number, measured according to the standard SCAN-P12:64, $Cobb_{60}$, of at least 50, said paper being coated with an aqueous dispersion of carboxymethylcellulose containing a non-crystalline saccharide syrup, whereafter one or more colour patterns are printed on said paper, each colour pattern comprising a water-soluble or dispersible dye admixed with an easily soluble thickening carrier with a temporary binding effect.

8. A pattern carrier according to claim 7, wherein said saccharide syrup comprises sorbitol.

9. A pattern carrier according to claim 8, wherein said saccharide syrup further comprises mannitol and reducing sugars.

10. A pattern carrier according to claim 9, wherein said saccharide syrup represents approximately 20% by weight of the dispersion.

11. A pattern carrier according to claim 7, wherein said saccharide syrup represents approximately 20% by weight of the dispersion.

12. A pattern carrier according to claim 7, wherein said aqueous dispersion is coated on said paper in an amount of approximately 30 g of dispersion per $m^2$ of paper.

13. A pattern carrier according to claim 7, wherein said thickening carrier is carboxymethylcellulose.

14. A method for transfer pattern printing a colour pattern to a moist textile web, comprising compressing said textile web and a pattern carrier according to claim 8 between one or more pairs of rollers without the use of heat, but under such a linear pressure that the textile web is compressed to a reduced thickness followed by a natural expansion, whereby a colour pattern is absorbed from the pattern carrier to the textile web.

15. A method according to claim 14, wherein said saccharide syrup comprises sorbitol.

16. A method according to claim 15, wherein said saccharide syrup further comprises mannitol and reducing sugars.

17. A method according to claim 14, wherein said saccharide syrup represents approximately 20% by weight of the dispersion.

18. A method according to claim 14, wherein said aqueous dispersion is coated on said paper in an amount of approximately 30 g of dispersion per $m^2$ of paper.

19. A method according to claim 14, wherein said thickening carrier is carboxymethylcellulose.

* * * * *